US006325500B1

(12) United States Patent
Kitabatake et al.

(10) Patent No.: US 6,325,500 B1
(45) Date of Patent: Dec. 4, 2001

(54) INK TANK, INK JET RECORDING APPARATUS MOUNTING THE INK TANK, AND PACKAGE FOR THE INK TANK

(75) Inventors: Kenji Kitabatake, Kawasaki; Shozo Hattori, Tokyo; Hajime Yamamoto; Eiichiro Shimizu, both of Yokohama; Hidehisa Matsumoto, Kawasaki; Jun Hinami, Yokohama; Hiroki Hayashi, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/598,310

(22) Filed: Jun. 21, 2000

(30) Foreign Application Priority Data

Jun. 23, 1999 (JP) ..... 11-177055
Jun. 15, 2000 (JP) ..... 12-180346

(51) Int. Cl.[7] ..... B41J 2/175
(52) U.S. Cl. ..... 347/86; 347/7
(58) Field of Search ..... 347/7, 85, 86, 347/87; 503/227

(56) References Cited

U.S. PATENT DOCUMENTS 5,837,648 * 11/1998 Tatchana et al. ..... 503/227
5,975,330 11/1999 Sasaki et al. ..... 220/495.01
5,997,121 * 12/1999 Altfather et al. ..... 347/7
6,012,795 * 1/2000 Saito et al. ..... 347/7
6,012,808 1/2000 Koitabashi et al. ..... 347/86

FOREIGN PATENT DOCUMENTS 6-40041 2/1994 (JP) .
9-267483 10/1997 (JP) .

* cited by examiner

*Primary Examiner*—Anh T. N. Vo
(74) *Attorney, Agent, or Firm*—Fitzpatrick, Cella, Harper & Scinto

(57) ABSTRACT

An ink tank provided with an ink containing portion containing ink therein, and a housing protecting the ink containing portion is characterized by a resin material capable of transmitting therethrough visible light and infrared light travelling from the exterior of the housing toward the interior of the ink containing portion and capable of decreasing ultraviolet light travelling from the exterior of the housing toward the interior of the ink containing portion.

16 Claims, 9 Drawing Sheets

FIG. 6A1
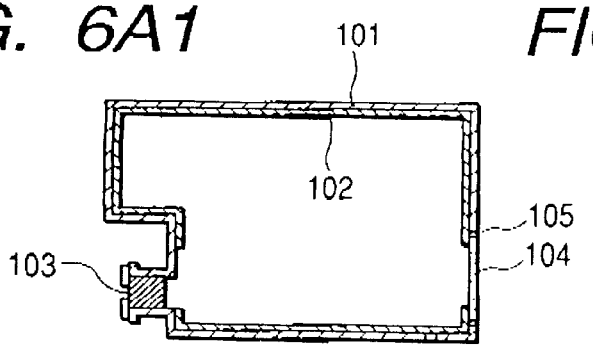
FIG. 6A2
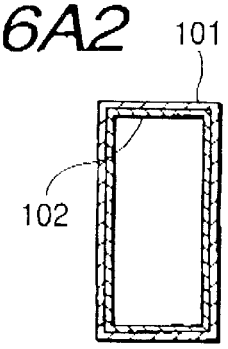
FIG. 6B1
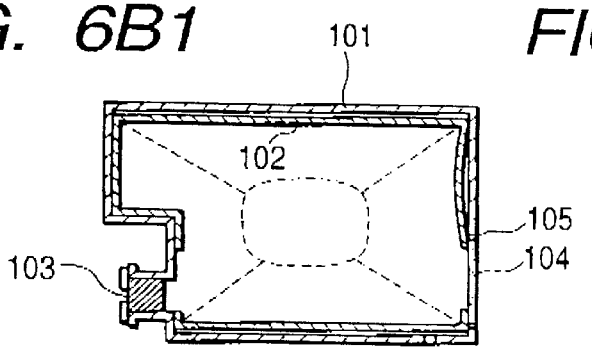
FIG. 6B2
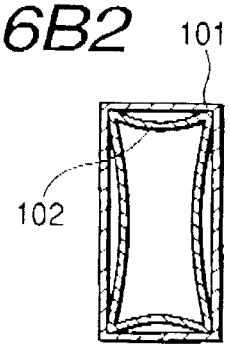
FIG. 6C1
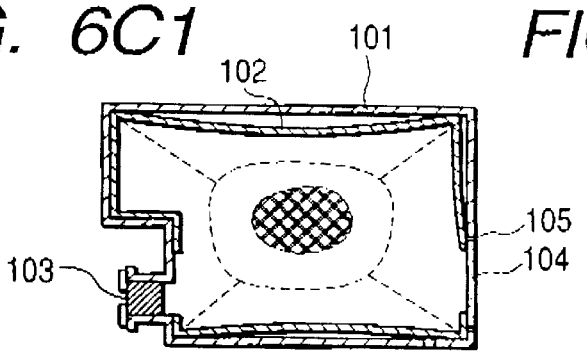
FIG. 6C2
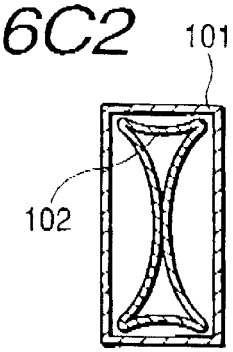
FIG. 6D1
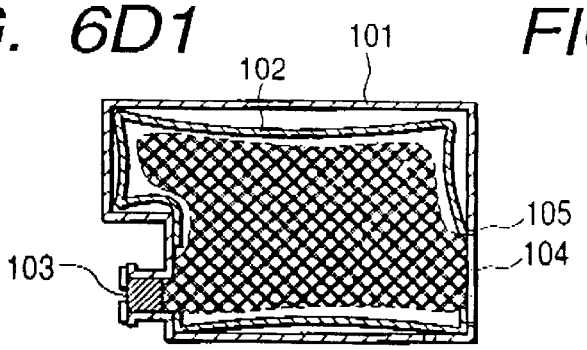
FIG. 6D2
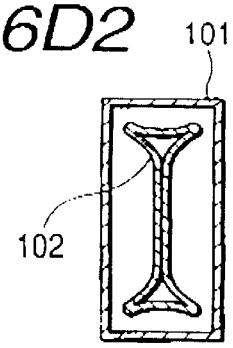

INK TANK, INK JET RECORDING APPARATUS MOUNTING THE INK TANK, AND PACKAGE FOR THE INK TANK

BACKGROUND OF THE INVENTION

1. Field of the Invention

This invention relates to an ink tank, an ink jet recording apparatus mounting the ink tank, and a package for the ink tank, and more particularly to a readily recyclable ink tank excellent in visual perceptibility, an ink jet recording apparatus mounting the ink tank, and a package for the ink tank.

2. Related Background Art

An ink jet recording apparatus discharges ink from recording means (a liquid discharge head) onto a recording medium to thereby effect recording, and have come into wide use in these several years because of its advantages such as being easy to make the recording means compact, being small in noise because of a non-impact type, and color images being easily formable because a variety of inks can be used.

With the spread of the ink jet recording apparatus in recent years, an increase in the quantity of ink used has been required.

So, recently, in order to improve the ink containing efficiency and the use efficiency, a construction as disclosed in Japanese Patent Application Laid-open No. 6-40041 wherein about a half space of the interior of an ink tank is filled with an ink absorbing material, and a construction as disclosed in Japanese Patent Application Laid-Open No. 9-267483 wherein an ink tank of multi-layer structure is used and an inner wall layer fluctuates with the use of ink and the ink is held by the reaction force thereof have been proposed and partly put into practical use.

Such an ink jet recording apparatus, because of its structure in which the ink is discharged to thereby effect printing, suddenly becomes incapable of printing when the ink in the ink tank becomes exhausted and therefore, it is desirable that the quantity of ink remaining in the ink tank be detectable. Therefore, an ink tank constituted by a transparent or translucent member transmitting visible light therethrough so that a user actually utilizing the apparatus can directly visually perceive the quantity of ink has been put into practical use. This also has the advantage that before the apparatus is loaded with an ink tank, what color of ink is contained in the ink tank can be easily confirmed.

Actually, there is a case where besides the detection of the quantity of remaining ink by the user's visual perception, optical type means for detecting the quantity of remaining ink is provided on the apparatus side. This means for detecting the quantity of remaining ink applies light from the outside of the ink tank to an ink storing portion, and detects the quantity of remaining ink by the difference in the intensity of the transmitted light or the reflected light thereof due to the presence or absence of the ink. Accordingly, to adopt this optical type detecting means, it is necessary for the ink tank to transmit visible light therethrough, and if only the ink tank thus has transmissively for the visible light, it is possible to incorporate this optical type detecting means relatively easily, and the error is small and the ink component is not affected.

In recent years, regarding images outputted by the ink jet recording apparatus, a photographic tone quality of image has been pursued and a higher quality of image has been required. Along therewith, the development of inks or the like having an excellent coloring property and weatherability has been advanced. As one of methods for realizing this photographic tone quality of image, a method of using ink of a lighter color than ordinary ink so that the feeling of stay of ink droplets discharged onto a recording medium such as paper may not remain, and moreover giving harmony to the print has been put into practical use.

However, when the ink of such a light color is contained in the aforedescribed conventional ink tank and is kept in custody and used, the color tone thereof may be deteriorated with the lapse of time. Particularly, ink having its dye density reduced to 1/5 or 1/10 as compared with conventional ink was poured into the ink tank and a fading resistance test was carried out with the result that the hue, chroma and brightness of the ink may change and a desired color tone may not be obtained.

This phenomenon came to be recognized as the result of the fact that the time for which the ink tank is mounted on the recording apparatus became long with an increase in the quantity of ink usable by an ink tank. Also, as the result of the spread of the ink jet recording apparatus, the ink tank which is an article of consumption is kept in custody under various environments, and even In ink tanks long displayed in stores, such a task has come to be recognized.

We have assiduously studied about this phenomenon to find that the ink contained in the ink tank having a light-transmitting property was exposed to ultraviolet rays and much of an ink dye dissolved therein was decomposed and changed in quality and the quantity residual while remaining the original dye decreased and the substantial density of the dye was reduced. It has therefore been found that a phenomenon called discoloring which means that a color becomes lighter occurs.

Moreover, of a plurality of colors (usually four colors or six colors) forming the color, the degree of influence of ultraviolet rays differs depending on the colors and the structure of dyes and in addition, the time for which the ink tank is exposed to ultraviolet rays varies from color to color depending on the hysteresis of use after the ink tank has been unsealed. Therefore, in some cases, the colors become generally discolored or only one color is discolored and the color balance is destroyed. Particularly, a change in which discoloring takes place gradually is a change difficult for most users to discriminate just as the CRT of a television becomes deteriorated, but when an ink tank used up has been interchanged, the problem we point out is remarkably recognized. That is, when printing has been started from an old ink tank in which dye components tend to discolor and that ink tank has been interchanged with an ink tank in which discoloring is hardly noticed to thereby effect continuous printing, prints which are the objects of comparison are near at hand and therefore, the recognition that the color is unusual cannot be avoided.

Now, a tank colored by the use of inorganic pigments or organic pigments and a tank increased in rigidity with a filler added thereto are shielded from ultraviolet rays. Such a construction, however, has not been desirable because the detection of the remaining quantity (presence or absence) of ink by the above-described optical detection of the remaining quantity is often difficult and the use is limited from the viewpoint of the recycle of the material.

Further, considering the form during sale, like the visual perceptibility of the ink contained in the ink tank is required, it is also desirable in a commodity package that a commodity (ink tank) therein can be seen. In such a case, among versatile resins, PS and PET are mentioned as typical transparent package materials, and with regard to these, regenerated materials are also circulated. However, PS is poor in a steam barrier property and therefore is liable to suffer from the problem that the ink evaporates and the density of a coloring material therein rises. PET has particularly the weak point that it is invaded by steam (ammonia) produced by the decomposition of urea prescribed for the prevention of the solidification and drying of the ink, and at least a package in the form of a bag has suffered from a problem.

SUMMARY OF THE INVENTION

So, it is an object of the present invention to provide an ink tank and an ink jet recording apparatus which secure the visual perceptibility by a user and make the utilization of optical type remaining quantity detecting means possible, and yet can prevent the change of the color tone of ink by ultraviolet rays.

It is another object of the present invention to provide related inventions such as an ink jet recording apparatus and a package for an ink tank based on the above-described novel idea.

To achieve the above objects, the ink tank of the present invention is an ink tank provided with an ink containing portion containing ink therein, and a housing protecting the ink containing portion, characterized by a resin material capable of transmitting therethrough visible light and infrared light travelling from the exterior of the housing toward the interior of the ink containing portion and capable of decreasing ultraviolet light travelling from the exterior of the housing toward the interior of the ink containing portion.

The ink tank of the present invention in another form is an ink tank provided with an ink containing portion containing ink therein, and a housing protecting the ink containing portion, characterized by a resin material capable of transmitting therethrough visible light and infrared light travelling from the exterior of the housing toward the interior of the ink containing portion, and containing an ultraviolet ray absorbing agent.

The present invention also provides a recording apparatus mounting the above-described ink tank, and a package for the ink tank.

The ink jet recording apparatus of the present invention is an ink jet recording apparatus having an ink tank containing ink therein, and an ink jet head for discharging the ink supplied from the ink tank toward a recording medium, characterized by optical type detecting means for detecting the quantity of remaining ink in the ink tank, the ink tank being provided with an ink containing portion containing the ink therein, and a housing protecting the ink containing portion, and having a resin material capable of transmitting therethrough visible light and infrared light travelling from the exterior of the housing toward the interior of the ink containing portion and capable of decreasing ultraviolet light travelling from the exterior of the housing toward the interior of the ink containing portion.

Also, the package of the present invention for an ink tank is a package for an ink tank provided with an ink tank containing ink therein, and a packing member covering the ink tank, characterized in that the packing member has a resin material capable of transmitting visible light and infrared light therethrough and capable of decreasing ultraviolet light.

BRIEF DESCRIPTION OF THE DRAWINGS

FIGS. 6A1, 6A2, 6B1, 6B2, 6C1, 6C2, 6D1 and 6D2 are schematic views successively showing the changes in the ink tank shown in FIGS. 5A to 5C during the outflow of the ink.

DETAILED DESCRIPTION OF THE PREFERRED EMBODIMENTS

Some embodiments of the present invention will hereinafter be described with reference to the drawings.

First Embodiment

Figure 1B:
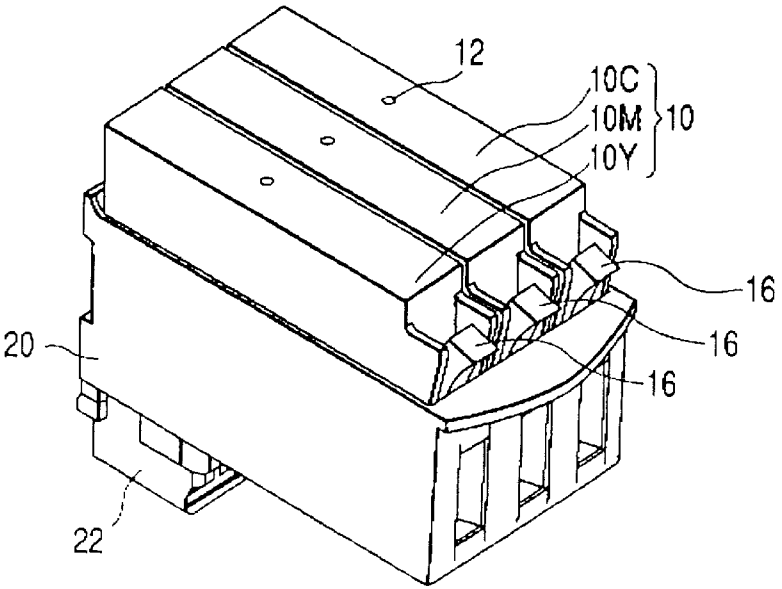
FIGS. 1A and 1B are perspective views of an ink tank and a tank case according to a first embodiment of the present invention.
Figure 1A:
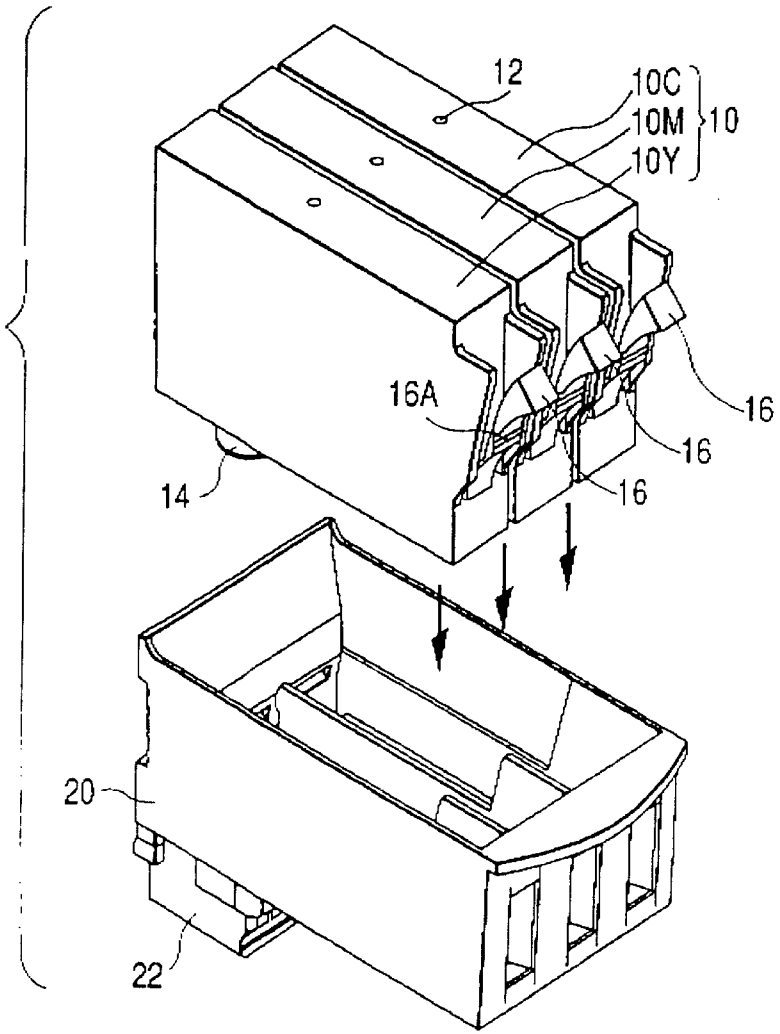

FIGS. 1A and 1B are schematic perspective views showing an ink tank according to a first embodiment of the present invention and an integral head type ink tank holder on which this ink tank is detachably mountable, FIG. 1A showing the state before the attachment of the ink tank, and FIG. 1B showing the state after the mounting of the ink tank.

The ink tank 10 which is a container containing therein, liquid to be discharged is substantially rectangular parallelepiped-shaped, arid the upper wall thereof is formed with atmosphere communication ports 12 which are apertures communicating with the interior of the ink tank. Also, the lower wall of the ink tank 10 is formed with an ink supply cylinder 14 cylindrically protruded and having a supply port for the liquid to be discharged (ink supply port). In the process of transportation, the atmosphere communication ports 12 are closed by a film sheet or the like, and the ink supply cylinder 14 is closed by a cap which is an ink supply port hermetically sealing member. Lever members 16 are elastically deformably formed on the outer side of the ink tank 10, and restraining projections 16A are formed on the intermediate portions thereof.

An integral head type tank case 20 on which the above-described ink tank 10 is mounted, in the present embodiment, contains therein ink tanks 10 (10C, 10M, 10Y)

of e.g. cyan C, magenta M and yellow Y. A color ink jet head 22 is integrally provided on the lower portion of the tank case 20. A plurality of discharge ports are downwardly formed in the color ink jet head 22 (that surface of the head in which these discharge ports are formed will hereinafter be referred to as the discharge port forming surface).

When the ink tank 10 is pushed from the state shown in FIG. 1A into the integral head type tank case 20, the ink supply cylinder 14 comes into engagement with the ink supply cylinder receiving portion, not shown, of the color ink jet head 22 and the ink path of the color ink jet head 22 communicates with the ink supply cylinder 14. The restraining projections 16A of the lever members 16 come into engagement with projections, not shown, formed at predetermined locations on the integral head type tank case 20, whereby the regular mounted state shown in FIG. 1B is obtained.

Figure 2:
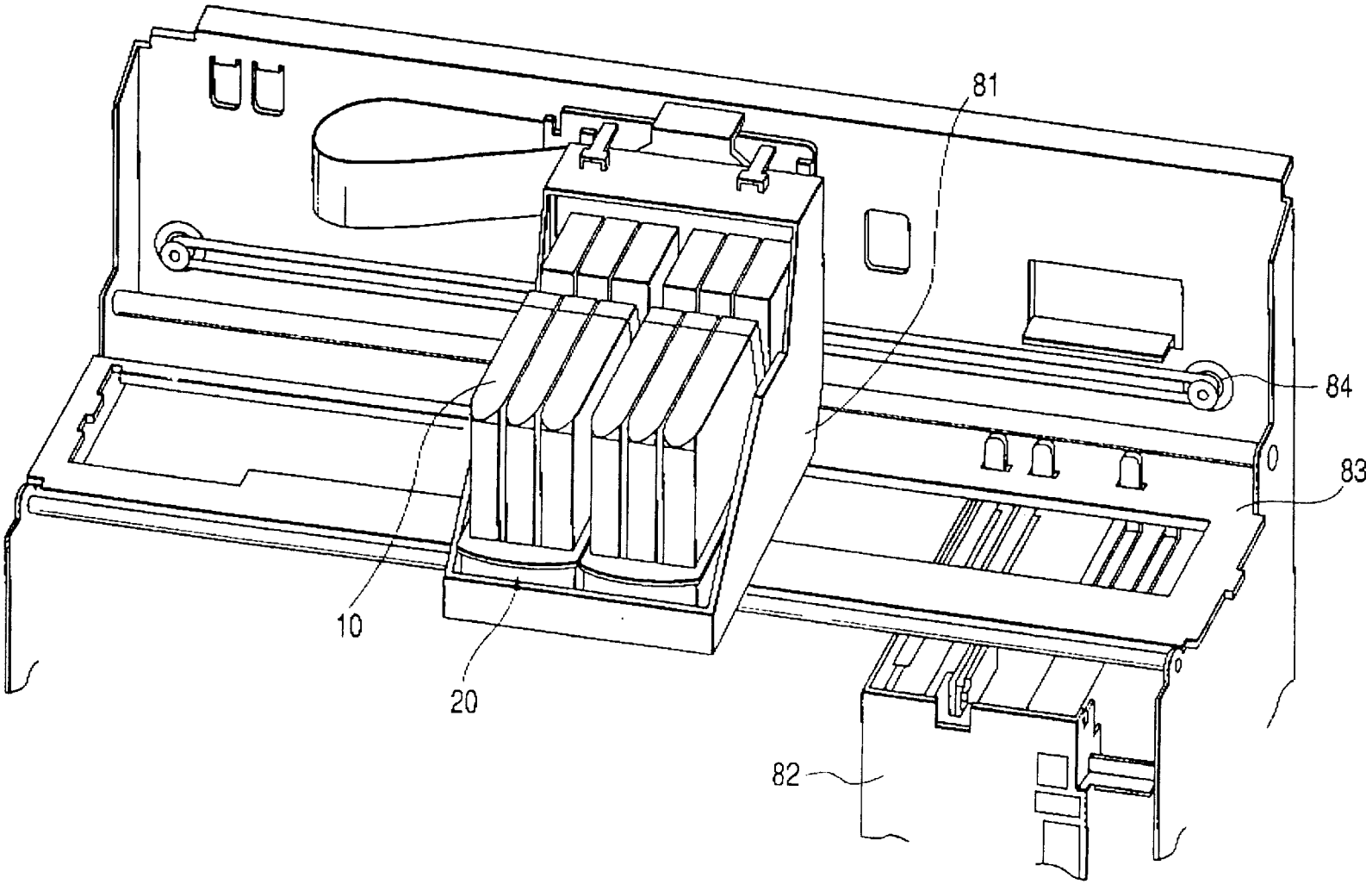
FIG. 2 is a perspective view of the essential portions of an ink jet recording apparatus according to the first embodiment of the present invention.

The integral head type tank case 20 on which the ink tank 10 has been mounted is mounted on the carriage 81 of an ink jet recording apparatus shown in FIG. 2. This ink jet recording apparatus is provided with the carriage 81 capable of removably mounting the tank case 20 thereon, a head recovery unit 82 having incorporated therein a head cap for preventing the drying of the ink from the plurality of orifices of the head and a suction pump for sucking the ink from the plurality of orifices during the bad operation of the head, and a paper feeding surface 83 on which recording paper as a recording medium is conveyed. The carriage 81 has its position on the recording unit 82 as its home position, and is leftwardly scanned as viewed in FIG. 2 by a belt 84 being driven by a motor or the like. During this scanning, the ink is discharged from the head toward the recording paper conveyed on the paper feeding surface (platen) 83, whereby printing is affected. In this state, a predetermined head difference H is formed between the bottom of the ink tank 10 and the discharge port forming surface of the head.

Figure 3:
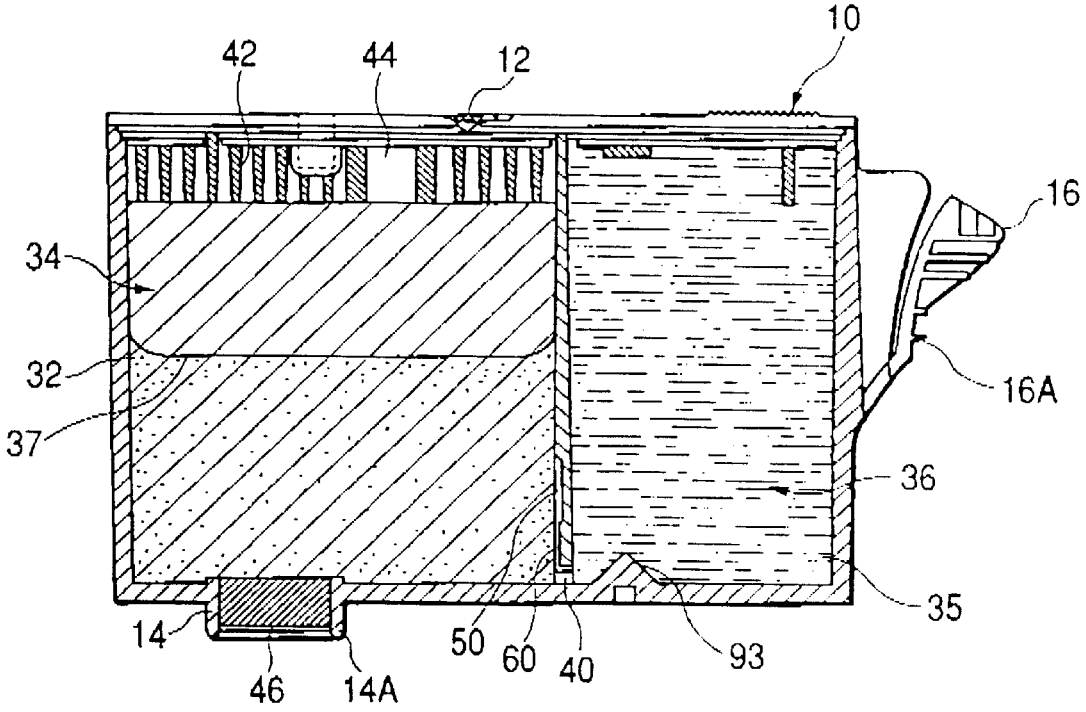
FIG. 3 is a cross-sectional view of the ink tank shown in FIGS. 1A, and 1B.

The internal structure of the ink tank 10 of the present invention will now be described in detail with reference to FIG. 3.

The ink tank 10 of the present embodiment includes a negative pressure generating member containing chamber 34 communicating in its upper portion with the atmosphere through the atmosphere communication port 12 and communicating in its lower portion with the ink supply port and containing therein an absorbing member 32 which is a negative pressure generating member, and a substantially hermetically sealed liquid containing chamber 36 containing therein ink which is liquid, and the two chambers 34 and 36 are partitioned by a partition wall 38. The first containing chamber 34 and the second containing chamber 36 communicate with each other near the bottom of the ink tank 10 only through a communication port 40 formed in the partition wall 38.

A plurality of inwardly protruding ribs 42 are integrally formed on the upper wall of the ink tank 10 which compacts the first containing chamber 34, and are in pressure contact with the absorbing member 32 contained in its compressed state in the first containing chamber 34. An air buffer chamber 44 is formed between the upper wall and the upper surface of the absorbing member 32. The absorbing member 32 is formed of thermocompression urethane foam, and is contained in its compressed state in the first containing chamber 34 to produce a predetermined capillary force.

Also, a disc-shaped or cylindrical pressure contact member 46 is disposed in the ink supply cylinder 14 defining the ink supply port. The pressure contact member 46 is formed of e.g. felt of polypropylene, and itself is not easily deformed by an extraneous force. The pressure contact member 46, in its state shown in FIG. 3 wherein it is not mounted on the tank case 20, is held in its pushed-in state so as to locally compress the absorbing member 32. For this purpose, a flange 14A abutting against the periphery of the pressure contact member 46 is formed on the end portion of the ink supply cylinder 14.

Figure 4B:
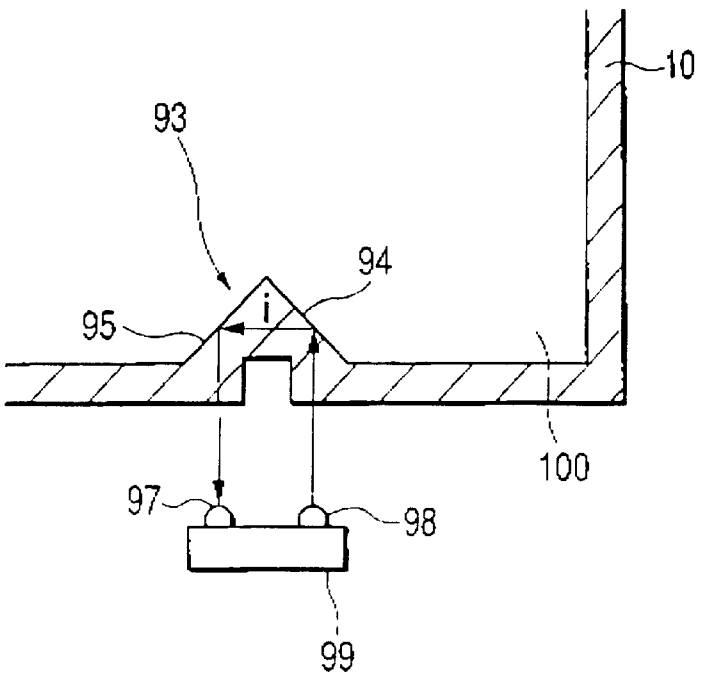
FIGS. 4A and 4B are illustrations showing an optical type method of detecting the quantity of remaining ink in the ink jet recording apparatus shown in FIG. 2, FIG. 4A showing a state in which there is a quantity of remaining ink, and FIG. 4B showing a state in which there is no quantity of remaining ink.
Figure 4A:
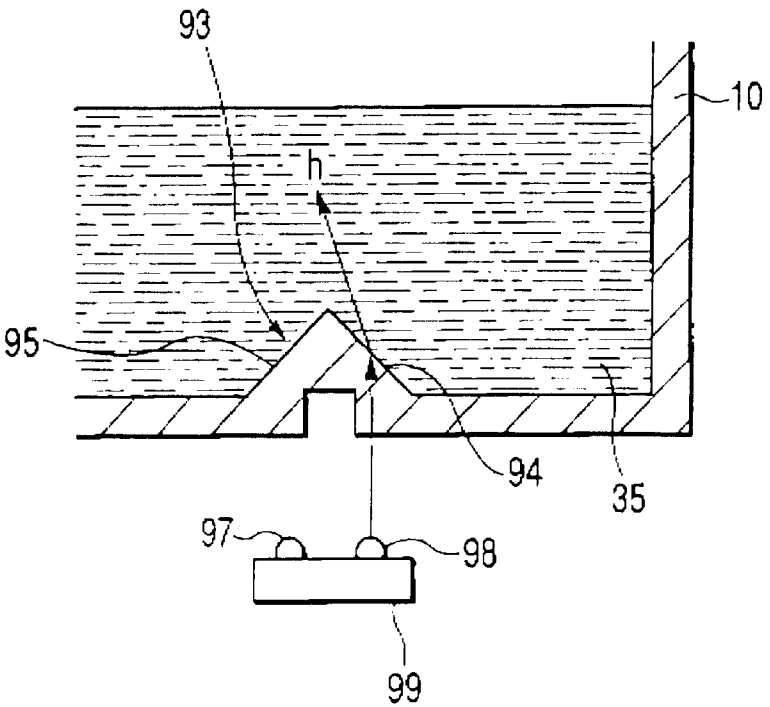

Also, a triangular projection 93 for effecting the optical type detection of the quantity of remaining ink is integrally provided on the bottom surface of the ink tank 10. This triangular projection 93 has two slope portions 95 and 94, and is formed of a material such as polypropylene which is nearly transparent and very approximate in refractive index to the ink 35. In the main body of the ink jet recording apparatus, there is provided optical type detecting means 99 having a light emitting portion 98 and a light receiving portion 97, as shown in FIGS. 4A and 4B.

When the ink jet recording apparatus is operated, the ink is discharged from the ink jet head 22 and along therewith, an ink sucking force acts on the interior of the negative pressure generating member containing chamber 34 of the ink tank 10. When the absorbing member 32 which is a negative pressure generating member in this negative pressure generating member containing chamber 34 is impregnated with a sufficient quantity of ink, the ink in the negative pressure generating member is consumed and the upper surface of the ink (the air-liquid interface 37) (see FIG. 3) is lowered. The magnitude of the generated negative pressure at this time is determined by the capillary force in the air-liquid interface of the negative pressure generating member and the height of the air-liquid interface 37 from the discharge port forming surface.

When the consumption of the ink progresses further and the pressure at the bottom of the liquid containing chamber 36 becomes lower than that in a second path 60 after the air-liquid interface 37 has arrived at the upper end portion of the first path 50 of an atmosphere Introduction path, air is supplied to the liquid containing chamber 36 through the first path 50 and the second path 60. AS the result, the pressure in the liquid containing chamber 36 rises correspondingly to the introduction of the air, and the ink is supplied from the liquid containing chamber 36 into the absorbing member 32 through the communication port 40 to eliminate the difference between this rising pressure and the pressure of the absorbing member 32 which is the negative pressure generating member. That is, air-liquid exchange is effected. At this point of time, the pressure at the bottom of the tank rises correspondingly to the quantity of supplied ink, and along therewith, the supply of the air to the liquid containing chamber 36 is stopped.

The above-described air-llquid exchange is continuously effected during the consumption of the ink, whereby the ink in the liquid containing chamber 36 is supplied into the negative pressure generating member containing chamber 34 at any time.

Description will now be made of the optical type detecting method of detecting the quantity of remaining ink in the present embodiment. According to the method in the present embodiment, light is applied from the light emitting portion 98 of the optical type detecting means 99 to the slope portion 94 of the triangular projection 93, and the reflected light of this light reflected by the slope portion 94 and the slope portion 95 is received by the light receiving portion 97, and the quantity of light reaching this light receiving portion 97 is converted into an electronic signal by the conventional photoelectric converting method to thereby effect the detection of the presence or absence of the ink 35 in the ink tank 10.

Specifically, when the ink 35 is sufficiently present in the ink tank 10, the two slope portions 94 and 95 of the triangular projection are in contact with the ink. The refractive index of the ink 35 is approximate to the refractive index of the material (polypropylene) of the ink tank 10 and therefore, when the ink tank is sufficiently filled with the ink 35, much light travels in the direction of arrow h indicated in FIG. 4A, and the quantity of light reflected by the slope portions 94 and 95 and received by the light receiving portion 97 is small. In contrast, when the ink 35 in the ink tank 10 is consumed and the quantity of remaining ink is reduced, the two slope portions 94 and 95 provided on the bottom of the liquid containing chamber 36 come into contact with the air 100 in an ink cartridge. Due to the difference in refractive index between the ink 35 and the air, the reflected light travelling in the direction of arrow i indicated in FIG. 4B becomes much, and much of the reflected light in the direction of arrow i is further reflected by the slope portion 95 and arrives at the light receiving portion 97. Accordingly, the quantity of light reaching the light receiving portion 97 becomes great. Thus, by the quantity of light received by the light receiving portion 97, the detection of the presence or absence of the ink 35 in the ink tank 10 becomes possible.

The material of the ink tank 10 will now be described.

The material of the ink tank 10 need have a light transmitting property as long as the aforedescribed optical type detecting means 99 is used. Further, if the ink tank 10 has a light transmitting property for visible light, there is the advantage that the user can visually confirm the kind of the ink and the quantity of remaining ink. To reduce the influence of illumination or the like in the printer installation environment, it is desirable that the light emitted by the optical type detecting means 99 be infrared light.

wavelength of the ultraviolet ray absorbing agent of the salicylic acid origin is 260 to 340 nm, the effective absorption wavelength of the ultraviolet ray absorbing agent of the benzophenon origin is 300 to 380 nm, the effective absorption wavelength of the ultraviolet ray absorbing agent of the benzotriazole origin is 300 to 385 nm, and the effective absorption wavelength of the ultraviolet ray absorbing agent of the cyanoacrylate origin is 290 to 400 nm.

Also, it is preferable that the resin forming the ink tank 10 contain an ultraviolet ray stabilizer such as hindered amine line stabilizer (HALS), in addition to the ultraviolet ray absorbing agent. This ultraviolet ray stabilizer does not have an ultraviolet ray absorbing property, but can markedly improve the weatherability of the resin by being used with the ultraviolet ray absorbing agent. Accordingly, a stable ultraviolet ray intercepting property by the improved weatherability of the outermost layer portion of the ink tank 10 can be secured.

The applicant carried out ultraviolet ray application experiments by pouring ink of the usually commercially available dye density, ink having dye density of ⅕, and ink having dye density of 1/10 into this ink tank 10. Also, as comparative examples, the applicant carried out ultraviolet ray application experiments by pouring three similar kinds of inks into an ink tank formed of polypropylene having no ultraviolet ray absorbing agent added thereto. The measuring conditions are such that the ink in the ink tank was picked at a point of time whereat an amount of irradiation of 0.39 $W/m^2$ was applied for 30 hours by the use of a xenon lamp having an output of 4.0 kW, a point of time whereat it was applied for 100 hours, a point of time whereat it was applied for 300 hours, and a point of time whereat it was applied for 500 hours, and ink absorbancy was measured and judged from L*a*b* color difference. The results are shown below.

| | | light application time | | | |
|---|---|---|---|---|---|
| ink | material of the tank | 30 hours | 100 hours | 300 hours | 500 hours |
| ordinary density dye 2.5% | no ultraviolet ray absorbing agent | excellent | excellent | excellent | ordinary |
| | containing ultraviolet ray absorbing agent | excellent | excellent | excellent | excellent |
| density ⅕ dye 0.5% | no ultraviolet ray absorbing agent | excellent | ordinary | ordinary | not excellent |
| | containing ultraviolet ray absorbing agent | excellent | excellent | excellent | excellent |
| density 1/10 dye 0.25% | no ultraviolet ray absorbing agent | excellent | ordinary | not excellent | not excellent |
| | containing ultraviolet ray absorbing agent | excellent | excellent | excellent | excellent |

The ink tank 10 of the present embodiment has a transmitting property for visible light and infrared light and has a light decreasing property for ultraviolet rays. That is, this ink tank 10 is formed of polypropylene having an ultraviolet ray absorbing agent added thereto. Specifically, as the ultraviolet ray absorbing agent, use is made of an ultraviolet ray absorbing agent of the salicylic acid origin, the benzophenon origin, the benzotriazole origin, the cyanoacrylate origin or the like. These ultraviolet ray absorbing agents differ in the adaptability to the base material (in the present embodiment, polypropylene) and the effective absorption wavelength from one another and therefore, one of them is suitably selected in accordance with use. The effective absorption As shown above, it has been found that by the ink tank having the ultraviolet ray absorbing action, the decomposition and deterioration of the ink dye by ultraviolet rays are suppressed and color change is suppressed (hue change (L*a*b*) is not noticed). In the present construction, polypropylene having the ultraviolet ray absorbing agent added thereto corresponds to an ink contacting layer and therefore, it is desirable to select an ultraviolet ray absorbing agent free of the influence on the ink by elution.

Also, the optical type method of detecting the quantity of remaining ink is not limited to the method by reflected light as described in the present embodiment, but a method using transmitted light or the like can be suitably selected.

Second Embodiment

A second embodiment of the present invention will now be described.

Figure 5A:
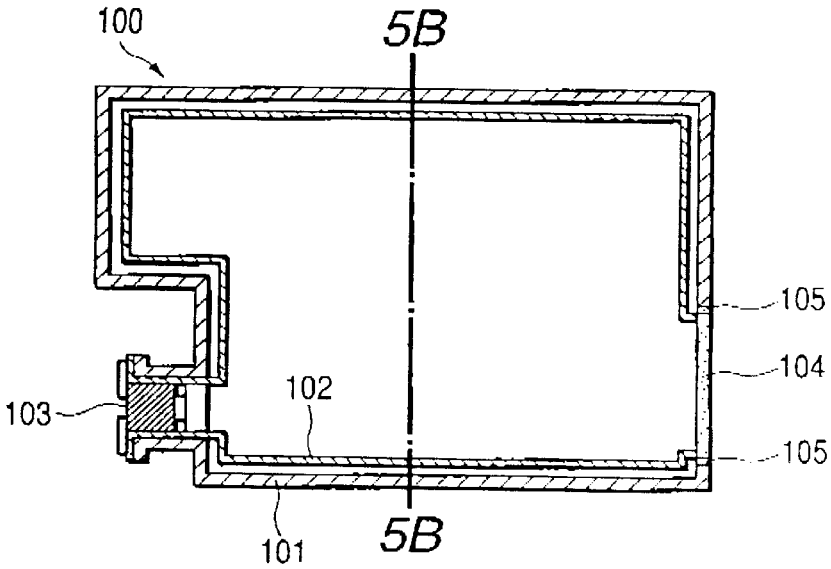
FIGS. 5A, 5B and 5C are typical schematic views showing the structure of an ink tank according to a second embodiment of the present invention, FIG. 5A being a cross-sectional view, FIG. 5B being a side view, and FIG. 5C being a perspective view.
Figure 5B:
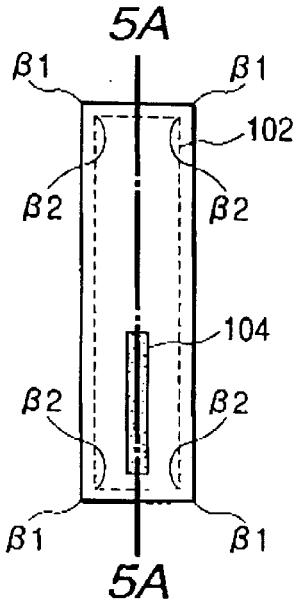
Figure 5C:
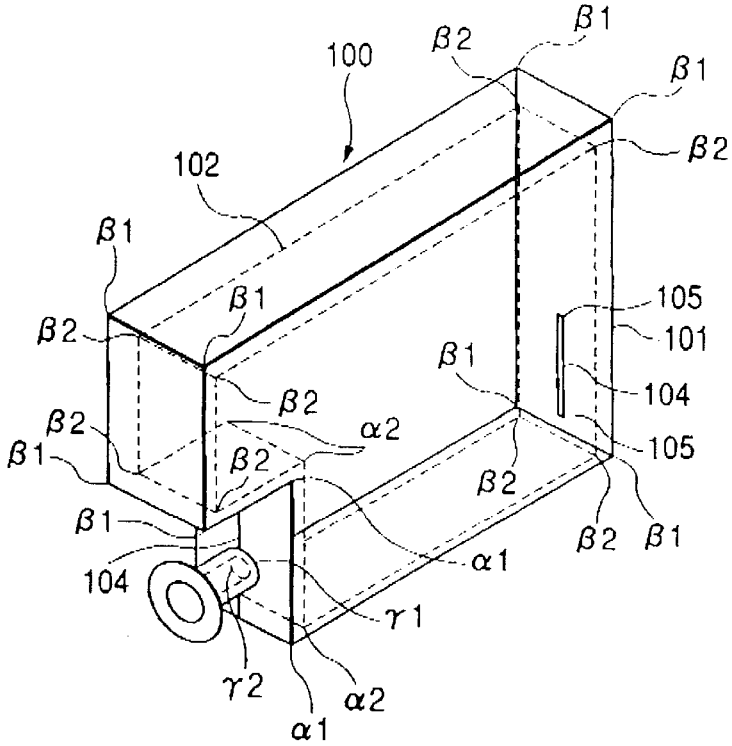

FIGS. 5A to 5C are schematic views showing the structure of an ink tank according to a second embodiment of the present invention, FIG. 5A being a cross-sectional view, FIG. 5B being a side view, and FIG. 5C being a perspective view. As can be seen from FIG. 5C, of the surfaces constituting the outer wall of the tank of FIGS. 5A to 5C, the surface of the largest area is a surface indirectly represented as in the cross-sectional view of FIG. 5A. Also, FIGS. 6A1 and 6A2 to 6D1 and 6D2 are schematic views successively showing the changes when ink is contained in the ink tank of FIGS. 5A to 5C and the ink is directed out from the ink supply portion of the ink tank, and the suffix 1 indicates a cross-sectional view along the line 5A—5A of FIG. 5B, and the suffix 2 indicates a cross-sectional view along the line 5B—5B of FIG. 5A. The ink tank of the present invention has its inner wall and outer wall formed at a time at one step by a direct flow molding method which will be described later.

The ink tank 100 of FIGS. 5A to 5C contains the ink in an area (hereinafter referred to as the ink containing portion) surrounded by the inner wall 102 separable relative to the outer wall 101 forming the outer block. The outer wall 101 is sufficiently thick as compared with the inner wall 102, and will be hardly deformed even if the inner wall 102 is deformed by the outflow of the ink. Also, the inner wall has a welded portion (pinch-off portion) 104, and in this welded portion, the inner wall is supported in such a manner as to be engaged with the outer wall. The outer wall has an air intake 105 near the pinch-off portion.

The ink tank shown in FIGS. 5A to 5C will now be described in detail. The ink tank 100 is constituted by eight flat surfaces, and has a cylindrical ink supply portion 103 added thereto as a curved surface. Of these eight surfaces, the surfaces of the largest area in the inner and outer walls which are on the opposite sides of the ink supply portion 103 are comparted by six corner portions ($\alpha$1, $\beta$1, $\beta$1, $\beta$1, $\beta$1, $\alpha$1) and ($\alpha$2, $\beta$2, $\beta$2, $\beta$2, $\beta$2, $\alpha$2), respectively.

When the ink in the ink containing portion begins to be consumed after the ink is discharged from the ink jet recording head of the ink jet recording means, the inner wall 102 begins to be deformed from the central portion of the surface of the largest area in a direction in which the volume of the ink containing portion decreases. Here, the outer wall acts to suppress the displacement of the corner portions of the inner wall. In this ink tank, there is little or no positional fluctuation of the corner portions comparted by the above-mentioned corner portions $\alpha$2 and $\beta$2 and therefore, the ink containing portion functions in a direction to stabilize negative pressure with the action force of deformation by the consumption of the ink and the action force trying to return to the shape in the initial state acting thereon.

At this time, air is introduced into between the inner wall 102 and the outer wall 101 through the air intake 105, and acts to maintain stable negative pressure during the use of the ink without hindering the deformation of the inner wall. That is, the space between the inner wall and the outer wall communicates with the atmosphere through the air intake 105. Thereafter, the force of the inner wall and the force of the meniscus in the discharge port of the recording head are balanced, whereby the ink is held in the ink containing portion (FIGS. 6B1 and 6B2).

When a considerable quantity of ink in the ink containing portion is further directed out (FIGS. 6C1 and 6C2), the ink containing portion is deformed as previously described, and the stable way of collapsing in which the central portion of the ink containing portion goes inwardly is maintained. Further, the welded portion 104 also becomes a portion for regulating the deformation of the inner wall, and with respect to the surface ajacent to the surf ace having the largest area, a portion having not the pinch-off portion begins to be deformed earlier than the area having the pinch-off portion 104, and becomes spaced apart from the outer wall.

In the above-described ink tank, polyethylene is used for the inner wall 102, and polypropylene having an ultraviolet ray absorbing agent added thereto is used for the outer layer.

Again in the present construction, it is possible to obtain an effect similar to that of the first embodiment. Also, in an ink tank comprising multi-layer structure like the present construction, an ultraviolet ray absorbing layer is provided outwardly of the ink-contacting layer, whereby it becomes unnecessary to pay attention to the elution of the ultraviolet ray absorbing agent into the ink and therefore, the range of the option thereof widens. Further, the outer wall 101 absorbs ultraviolet rays, and this leads to the effect of preventing the problem that the elasticity or hardness of the inner wall 102 which dominates negative pressure is changed by the application of ultraviolet rays and the negative pressure is changed.

Of course, the present construction is not restricted to the above-described two-layer construction, but three layers, four layers or more layers can be selected as required. In that case, by disposing an ultraviolet ray absorbing layer on the outermost layer, it becomes unnecessary to add ultraviolet ray absorbing action to a layer disposed therein, and this leads to a reduction in cost.

In the aforedescribed embodiment, the outer layer material is polypropylene and therefore, an ultraviolet ray absorbing agent of the benzophenon origin is preferable in terms of compatibility. Further, with the liquid contacting property and the negative pressure characteristic attributable to the elastic force of blow taken into consideration, it is desirable to use resin having an ultraviolet ray absorbing agent added to the outermost layer which is small in influence. If an ultraviolet ray absorbing agent of which the liquid-contacting property is secured is selected, use is of course possible even in an ink tank in the form of a single layer.

Third Embodiment

A third embodiment of the present invention will now be described.

The ink contained in the ink tank of the present invention is ink having the property of being hardened by receiving the application of ultraviolet rays (UV hardenable ink), and the printer has incorporated therein an ultraviolet light source for quickly hardening the UV hardenable ink discharged to the surface of paper during printing. Specifically, by applying ultraviolet rays during the time from after the UV hardenable ink discharged from the head is shot on the surface of paper and an image is formed thereon until the paper is discharged, the fixation of the ink on the surface of the paper can be improved. However, the interior of the printer is exposed to ultraviolet rays during printing, and with the aid of reflected light and stray light, the ink tank disposed in the printer is irradiated with ultraviolet rays. As previously described, the ink contained in the ink tank is UV hardenable ink and therefore, by the ink tank containing an ultraviolet ray absorbing agent and having an intercepting property or a decreasing property for ultraviolet rays, the ink can be prevented from being hardened in the ink tank.

It is desirable that the intercepting property or the decreasing property for ultraviolet rays be had not only in the interchangeable tank portion, but also in the ink supplying system and the head portion.

Fourth Embodiment

A fourth embodiment of the present invention will now be described.

Figure 7:
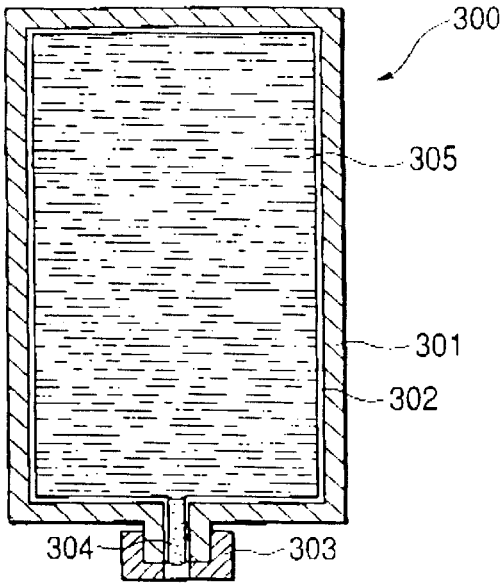
FIG. 7 is a typical cross-sectional view of an ink tank according to a fourth embodiment of the present invention.

While in the second embodiment, there has been shown a form in which an ink containing bag capable of generating negative pressure and a housing are of multi-layer structure, the present invention is also effective in a case where as shown in FIG. 7, the layers of multi-layer structure are non-peeling (adhesively secured to one another). In FIG. 7, an ink tank 300 is such that a container outer layer 301 forming a housing and a container inner layer 302 forming an ink containing portion directly containing ink 305 therein are made integral with each other. The outer layer 301 is thick as compared with the inner layer 302, and a plug member 304 and a plug cap 303 are provided in an ink supply port portion.

In this case, to suppress the amount of addition of the ultraviolet ray absorbing agent from the viewpoints of cost and recycle, and prevent the interaction between the ultraviolet ray absorbing agent and the ink it is preferable to give the ultraviolet ray decreasing function only to the outer possible layer as viewed from the ink containing area, instead of giving the ultraviolet ray decreasing function to all layers.

Figure 9A:
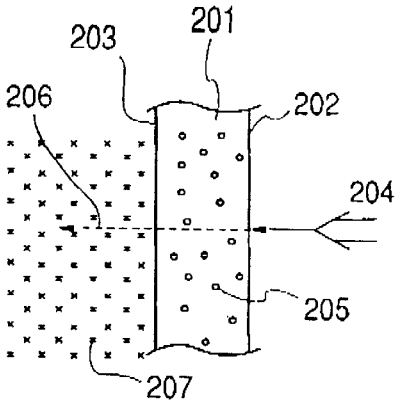
FIGS. 9A, 9B, 9C, 9D and 9E are illustrations for illustrating resin materials according to respective embodiments of the present invention and the transmission of ultraviolet light.

As described above, as in the aforedescribed second embodiment and the present embodiment, the container in which resin is formed into multiple layers can be easily manufactured by being molded by blow molding. The advantages when such a container is molded by blow molding will be complementarily described with reference to FIGS. 9A to 9E while being compared with the other embodiments In the first embodiment, as shown in FIG. 9A, contained ink 207 is surrounded by resin 201 constituting the container. The ink 207 is not limited to that directly contained in the container, but may be ink held by an absorbing member (32 in FIG. 3) in the container. An ultraviolet ray 204 (a component of the sunlight) travelling from the outside of the ink tank container toward the container goes from the outer surface 202 of the container into the container, but is decreased by an ultraviolet ray absorbing agent 205 existing in the resin and assumes a problem-free light quantity level 206 from the inner wall surface 203 of the ink containing surface side.

Figure 9D:
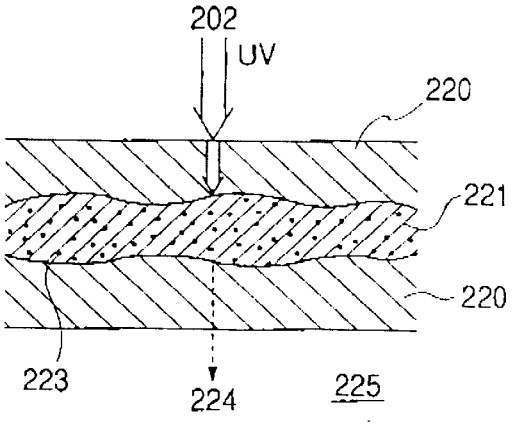
Figure 9B:
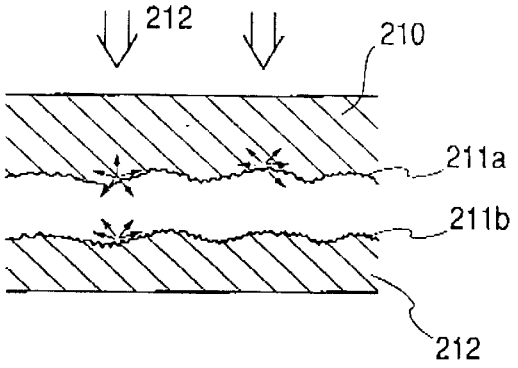

On the other hand, in the aforedescribed second embodiment and the present embodiment, the container is an ink containing container made by direct blow molding and therefore, as shown in FIG. 9B, the surface contacting with a metal mold, i.e., the outer layer surface 210, is obtained as a surface of roughness corresponding to the finished surface of the metal mold, but the inner layer surface which does not contact with the metal mold produces minute chapping. Particularly, among the blow molding methods, the direct blow molding method, as compared with the drawing blow molding method, is molding in the molten state of resin and therefore is basically non-drawing molding and thus, the roughness of the above-mentioned surface is remarkable. Also, the interface 211 between a housing 208 and an inner layer 209 thinner than the outer layer thereof is proximate to a chapped inner surface 212 and extends with great waviness. After the outer layer 208 and the inner layer 209 have been peeled off, minute and irregular unevenness is formed on the wavy surface, and brings about the effect of scattering an ultraviolet ray 212 entering from the outside. The reference numeral 213 represents the scattering on the housing side surface 211*a* after the peeling-off of the interface 211, and the reference numeral 214 represents the scattering on the ink bag side surface 211*b*.

Figure 9E:
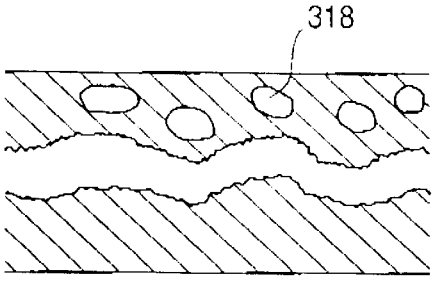
Figure 9C:
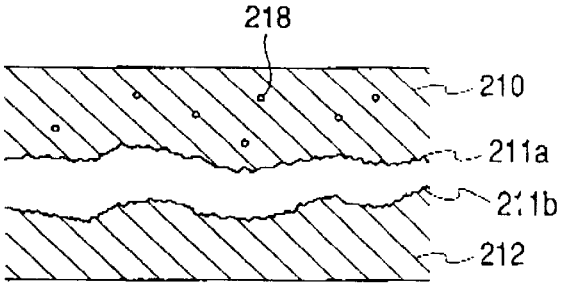

The ultraviolet ray decreasing action is obtained by virtue of this effect. Of course, as shown in FIG. 9C, an ultraviolet ray absorbing agent 218 may be used together. In that case, it is desirable that the ultraviolet ray absorbing agent be contained in the other layers than the resin material forming the layer contacting with the ink, i.e., the resin layers outer toward the outside of the area containing the ink therein. Or as shown in FIG. 9E, resin 318 which becomes granular may be added to any of the resin layers. In this case, the light decreasing effect can be obtained by virtue of the refraction and scattering of the light on the surface of the granular resin 318.

When the container is of multi-layer structure as described above, any one layer can contain the ultraviolet ray absorbing agent therein, and the selectivity of the other layers widens. Therefore, when the contacting property with the ink is taken into account, it is desirable to give the ultraviolet ray decreasing function to the other layers than the innermost layer forming the ink containing portion.

Fifth Embodiment

A fifth embodiment of the present invention will now be described.

Figure 8A:
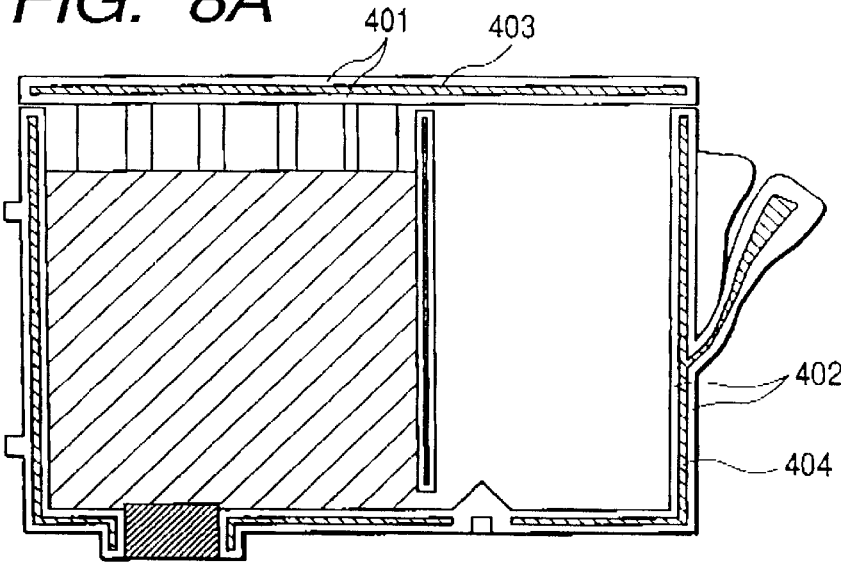
FIGS. 8A and 8B are illustrations illustrating an ink tank according to a fifth embodiment of the present invention, FIG. 8A being a typical cross-sectional view of the ink tank, and FIG. 8B being a cross-sectional view of the essential portions of the ink tank.
Figure 8B:
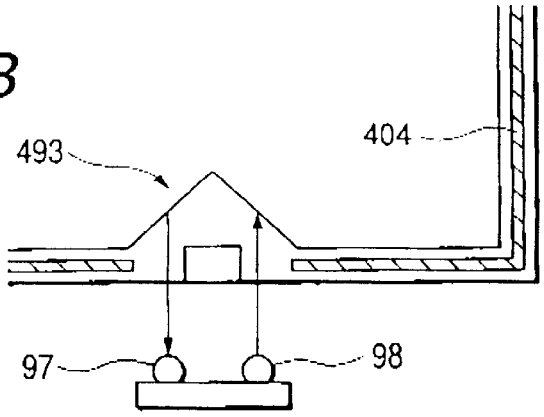

In the aforedescribed first embodiment, the ultraviolet ray absorbing agent is contained in the container forming material of the single-layer container made by injection molding to thereby decrease the ultraviolet rays reaching the ink contained in the container. In the present embodiment, as shown in FIG. 8A, by the use of the sandwich molding technique, the ultraviolet ray absorbing agent is not contained in skin layers 401 and 402, but is contained in core layers 403 and 404. In this structure, as shown in FIG. 9D, a core layer 221 as a layer containing the ultraviolet ray absorbing agent 223 is sandwiched between skin layers 220 and thus, does not directly contact with the ink 225, and this leads to the advantage that the range of selection of the absorbing agent widens, and recycled resin can be used for the core layer 221. As regards a prism portion 493 for the optical type detection of the quantity of remaining ink, in order to properly secure the path of light emission and light reception, it is desirable to contrive the gate position of a core material so as not to become sandwich structure, as shown in FIG. 8B.

Again in the present construction, it is possible to obtain an effect similar to that of the first embodiment.

Sixth Embodiment

A sixth embodiment of the present invention will now be described.

While the ink tank transmitting visible light therethrough is mentioned in the aforedescribed embodiments, even a construction in which the user cannot sufficiently see through the interior of an ink tank, for example, a milk white ink tank, transmits ultraviolet rays therethrough. Again in that case, from the viewpoint of the denaturation of the ink, it is effective for the ink tank to contain the ultraviolet ray absorbing agent and have the ultraviolet ray intercepting or decreasing property. In such a form, an infrared LED emitting infrared light is used as a light source, whereby the optical type detection of the quantity of remaining ink is possible even in a case where sufficient detection accuracy is not obtained by visible light.

Seventh Embodiment

A seventh embodiment of the present invention will now be described.

While in the aforedescribed embodiments, the light intercepting property or the light decreasing property for ultraviolet rays is given to the ink tank itself, the ink tank itself need not always have the light intercepting property or the light decreasing property for ultraviolet rays, for example, in the viewpoints of the time of transportation and the time of sale, but a packing member packing the tank can have the light intercepting property or the light decreasing property for ultraviolet rays. In that case, however, the above-described effect can be achieved in the state of a so-called package in which the ink tank is packed by a packing member, but no assurance Is given against the influence of ultraviolet rays during the use of the ink tank, and the constructions of the aforedescribed first to sixth embodiments are desirable in such an ink tank as is used for a long term in the form of a single ink tank after the unsealing of the package, for example, a tank of large capacity or the like.

Figure 10A:
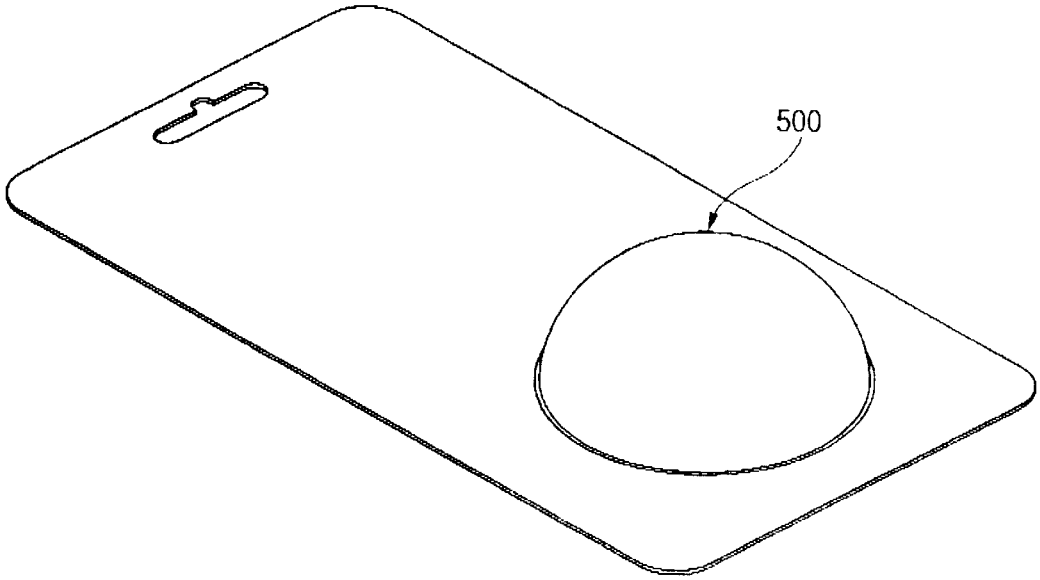
FIGS. 10A and 10B are illustrations for illustrating examples of the package of the present invention.
Figure 10B:
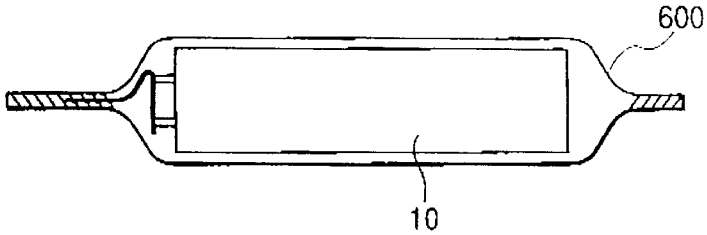

As embodiments of the package, mention is made of a hard blister package 500 containing an ink tank therein as shown in FIG. 10A, and a bag 600 of resin containing an ink tank 100 therein as shown in the cross-sectional view of FIG. 10B. So, as resin materials suited for such packages, polypropylene and polystyrene which are versatile resin and polyethylene terephthalate (PET) which is not always excellent in the fitness to ink, but yet is versatile resin were compared and studied. As packages for an ink tank containing magenta ink of dye of 0.25% density therein, the following results were obtained in the comparison during the aforedescribed 100 hours of application test. (The ink tank is formed of random copolymer polypropylene (transparent material) having an average thickness of 0.8 mm and contains no ultraviolet ray absorbing agent.)

| | 100 hours |
|---|---|
| PET bag (thickness 70 $\mu$m) | excellent |
| PP bag (thickness 70 $\mu$m) | not excellent |
| PP bag containing the ultraviolet ray absorbing agent (thickness 70 $\mu$m) | excellent |
| PET hard blister package (thickness 0.4 mm) | excellent |
| PP hard blister package (thickness 0.4 mm) | not excellent |
| PP hard package containing the ultraviolet ray absorbing agent (thickness 0.4 mm) | excellent |
| no package (ink tank alone) | not excellent |

Like the ink tank, it is excellent from the viewpoint of recycle to form the package of the same material as olefin resin inexpensive as an ink tank material and having chemical resistance, for example, polypropylene. However, straight chain olefin including polypropylene, although not so as acryl (PMMA), hardly absorbs but transmits ultraviolet rays therethrough.

So, as is apparent from the results shown above, with regard also to the package for the ink tank, polyolefin is made to contain the ultraviolet ray absorbing agent, whereby during the sale as well, change in the quality of the ink in the ink tank can be prevented more reliably end effectively.

While it is ultraviolet rays to dye that we have recognized as the problem and have described as the object of solution, the component which changes in quality to ultraviolet rays is not limited to dye, but may be any component constituting the ink that affects the dignity of image, the ink supplying performance, etc. under the influence of ultraviolet rays. For example, insoluble polymer particles as dispersion assistant in pigment ink or the like correspond to it.

As described above, according to the present invention, in an ink tank capable of transmitting visible light therethrough so as to be visually perceptible, or capable of transmitting at least infrared rays therethrough so that the optical detection of the quantity of remaining ink may be possible, or a package for the ink tank, the inconvenience in ink jet recording by the change in the quality of a particular component of ink contained therein caused by ultraviolet rays can be prevented. Particularly in the case of multi-layer structure, the light decreasing function is given to the outerer layers which do not contact with the ink, whereby the ink tank can be achieved inexpensively without the ink-contacting property being spoiled. Further, by adopting sea island structure of two or more elements in at least one layer,by the scattering and refraction on the surface of an island component, or in the case of multi-layer peeling structure, by the reflection on the boundary surface, it becomes possible not to use the ultraviolet ray absorbing agent or to reduce the contact thereof.

What is claimed is:

1. An ink tank comprising an ink containing portion containing ink therein, and a housing protecting said ink containing portion, at least a portion of said housing being formed by a resin material not in contact with said ink and having a light transmission property such that visible light and infrared light are transmitted therethrough and such that transmission of ultraviolet light is decreased.

2. An ink tank according to claim 1, wherein said housing is formed chiefly of polyolefin resin.

3. An ink tank according to claim 1, wherein the resin material forming-said ink portion of said tank is molded with a non-drawing molding process and the surface of said resin material decreases ultraviolet light transmitted into said ink containing portion.

4. An ink tank according to claim 1, wherein said ink tank is formed of a resin material of multi-layer structure having an inner layer forming said ink containing portion, an outer layer forming said housing, and an intermediate layer positioned between said outer layer and said inner layer, wherein said intermediate layer has a light transmitting property such that transmission of ultraviolet light is decreased.

5. An ink tank according to claim 4, wherein said inner layer and said outer layer are peelable, and a thickness of a resin layer forming said outer layer is greater than a thickness of a resin layer forming said inner layer.

6. An ink tank according to claim 1, wherein said ink tank is formed of a resin material of multi-layer structure having an inner layer forming said ink containing portion, and an outer layer forming said housing, said outer layer containing a higher percentage of ultraviolet ray absorbing agent than said inner layer.

7. An ink tank according to claim 6, wherein said inner layer and said outer layer are peelable, and a thickness of a resin layer forming said outer layer is greater than a thickness of a resin layer forming said inner layer.

8. An ink tank comprising an ink containing portion containing ink therein, and a housing protecting said ink containing portion, at least a portion of said housing being formed by a resin material not in contact with said ink and having a light transmission property such that visible light and infrared light are transmitted therethrough, said resin material containing portion, and containing an ultraviolet ray absorbing agent.

9. An ink jet recording apparatus comprising:

an ink tank containing ink therein;

an ink jet head for discharging the ink supplied from said ink tank toward a recording medium; and optical detecting means for optically detecting the quantity of remaining ink in said ink tank;

said ink tank comprising an ink containing portion containing the ink therein, and a housing protecting said ink containing portion, at least a portion of said housing being formed by a resin material not in contact with said ink and having a light transmission such that visible light and infrared light are transmitted therethrough and such that transmission of ultraviolet light is decreased.

10. An ink jet recording apparatus according to claim 9, wherein said optical detecting means is for detecting rays of light passing through the ink containing portion of the ink tank, and for detecting a change in light reflectance on a boundary between a wall surface of said ink tank and said ink.

11. An ink jet recording apparatus according to claim 9, wherein said optical detecting means is for detecting rays of light passing through the ink containing portion of the ink tank, and for detecting a change in transmittance of said rays of light transmitted through said ink.

12. A package for an ink tank comprising an ink tank receptacle and a packing member covering said ink tank receptacle, wherein said packing member has a resin material with a light transmission property such that visible light and infrared light are transmitted therethrough and such that transmission of ultraviolet light is decreased.

13. A package for an ink tank according to claim 12, wherein said package is formed from a resin material chiefly constituted by a polyolefin containing an ultraviolet ray absorbing agent.

14. A package for an ink tank according to claim 12, wherein dye ink is contained in said ink tank.

15. A package for an ink tank according to claim 12, wherein said ink tank is formed of a resin material of multi-layer structure having an inner layer forming an ink containing portion containing the ink therein, an outer layer forming a housing, and an intermediate layer positioned between said outer layer and said inner layer, wherein said intermediate layer has a light transmitting property such that transmission of ultraviolet light is decreased.

16. A package for an ink tank according to claim 12, wherein said ink tank is formed of a resin material of multi-layer structure having an inner layer forming an ink containing portion containing the ink therein, and an outer layer forming a housing, said outer layer containing a higher percentage of ultraviolet ray absorbing agent than said inner layer.

* * * * *

UNITED STATES PATENT AND TRADEMARK OFFICE

CERTIFICATE OF CORRECTION

PATENT NO. : 6,325,500 B1
DATED : December 4, 2001
INVENTOR(S) : Kenji Kitabatake et al.

It is certified that error appears in the above-identified patent and that said Letters Patent is hereby corrected as shown below:

Column 1,
Line 16, “have” should read -- has --.

Column 2,
Line 22, “In” should read -- in --; and
Line 24, “about” should be deleted.

Column 6,
Line 38, “Introduction” should read -- introduction --;
Line 40, “AS” should read -- As --;
Line 48, “of” (first occurrence) should read -- in --; and
Line 52, “air-llquid” should read -- air-liquid --.

Column 7,
Line 19, “much,” should read -- great, --; and
Line 27, “need” should read -- needs to --.

Column 9,
Line 12, “and 6A2 to 6D1 and 6D2” should read -- to 6D2 --; and
Line 56, “into” should be deleted.

Column 10,
Line 5, “surf ace” should read -- surface --;
Line 6, “having not” should read -- not having --; and
Line 21, “option” should read -- options --.

Column 11,
Line 2, “be had not only” should read -- had not only be --.

Column 12,
Line 13, “resin layers outer” should read -- outer resin layers --; and
Line 43, “with” should be deleted.

Column 13,
Line 19, “Is” should read -- is --;
Line 30, “resin” should read -- resins, --;
Line 32, “but yet is versatile resin” should read -- yet is versatile, resins --;
Line 54, “recycle” should read -- recycling --;
Line 55, “resin” should read -- resin, --; and
Line 65, “end” should read -- and --.

UNITED STATES PATENT AND TRADEMARK OFFICE

CERTIFICATE OF CORRECTION

PATENT NO. : 6,325,500 B1
DATED : December 4, 2001
INVENTOR(S) : Kenji Kitabatake et al.

It is certified that error appears in the above-identified patent and that said Letters Patent is hereby corrected as shown below:

Column 14,
Line 16, “outerer” should read -- outermost --;
Line 17, “with” should be deleted;
Line 21, “layer,by” should read -- layer, by --; and
Line 37, “forming-said” should read -- forming said --.

Column 15,
Line 8, “tank;” should read -- tank, --.

Signed and Sealed this

Second Day of July, 2002

*Attest:*

*Attesting Officer*

JAMES E. ROGAN
*Director of the United States Patent and Trademark Office*